US005819453A

United States Patent [19]

Eichert et al.

[11] Patent Number: 5,819,453

[45] Date of Patent: Oct. 13, 1998

[54] DISPLAY STAND

[75] Inventors: Lance H. Eichert, Conshohocken, Pa.; Joseph P. Zucconi, Marlton, N.J.

[73] Assignee: Mars, Incorporated, McLean, Va.

[21] Appl. No.: 800,514

[22] Filed: Feb. 14, 1997

[51] Int. Cl.[6] ..... G09F 19/08

[52] U.S. Cl. ..... 40/411; 248/174

[58] Field of Search ..... 248/174, 165, 248/166, 150, 188.6, 183, 161, 104, 458, 459, 346.3, 431; 40/411, 414, 430, 473, 606; 229/108.1, 110, 117.13–117.15; 206/745, 748, 750, 767

[56] References Cited

U.S. PATENT DOCUMENTS

| | | | |
|---|---|---|---|
| 1,281,501 | 10/1918 | Brown | 248/174 |
| 2,735,606 | 2/1956 | Paige | 206/418 |
| 2,936,145 | 5/1960 | Woelky | 248/174 |
| 3,912,156 | 10/1975 | May | 229/37 R |
| 4,641,445 | 2/1987 | Rossi | 40/410 |
| 4,998,364 | 3/1991 | Sengstaken | 40/411 |
| 5,018,288 | 5/1991 | Yang | 40/406 |
| 5,070,633 | 12/1991 | Liu | 40/411 |
| 5,088,218 | 2/1992 | Liu | 40/411 |
| 5,483,763 | 1/1996 | Liu | 40/414 |
| 5,601,355 | 2/1997 | Valentino | 362/35 |
| 5,617,658 | 4/1997 | Chen | 40/411 |

*Primary Examiner*—Leslie A. Braun
*Assistant Examiner*—T. Le
*Attorney, Agent, or Firm*—Fitzpatrick, Cella Harper & Scinto

[57] ABSTRACT

A collapsable display stand is disclosed which includes a vertical pole having a rotatable element. The display stand has hexagonal top and bottom openings and twelve sides to provide a spiral twist-like appearance. The display stand is formed from a foldable blank having two free ends and six integral rectangular panels separated by a set of parallel first fold lines respectively located along the sides of the rectangular panels. The rectangular panels also have a second set of fold lines located diagonally in the panels and parallel to each other to define two triangular panel segments in each of the rectangular panels. The rectangular panels also have a central opening formed along their associated diagonal fold lines. By this construction when the blank is folded in a first direction along the first set of fold lines and in a second direction about the second fold lines, and when the free ends of the panels are joined together, the blank defines a structure having twelve triangular sides and hexagonal top and bottom edges. The central portion of the structure between the top and bottom edges has a maximum dimension that is less than the maximum dimension of the top and bottom edges. The openings in the rectangular panels also form a handhold when the structure is collapsed in flat form. In addition, a pole support is provided which is adapted to be secured in the display stand. The pole support includes an elongated display pole having an open upper end and an electric motor supported therein which serves to rotate a sign display.

19 Claims, 6 Drawing Sheets

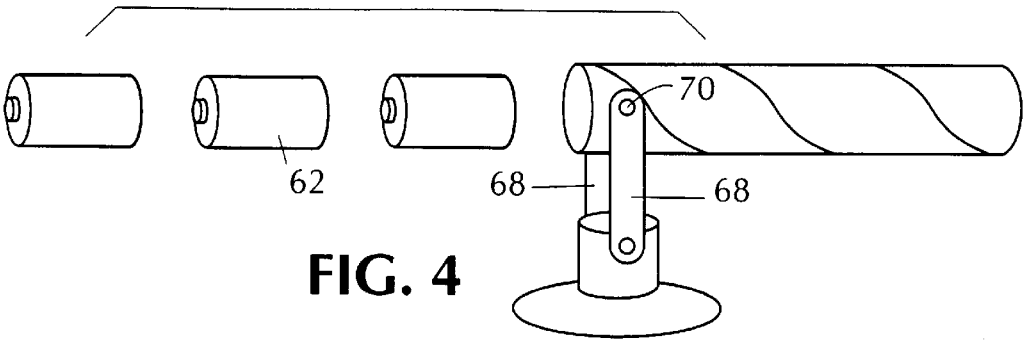
FIG. 4
FIG. 6
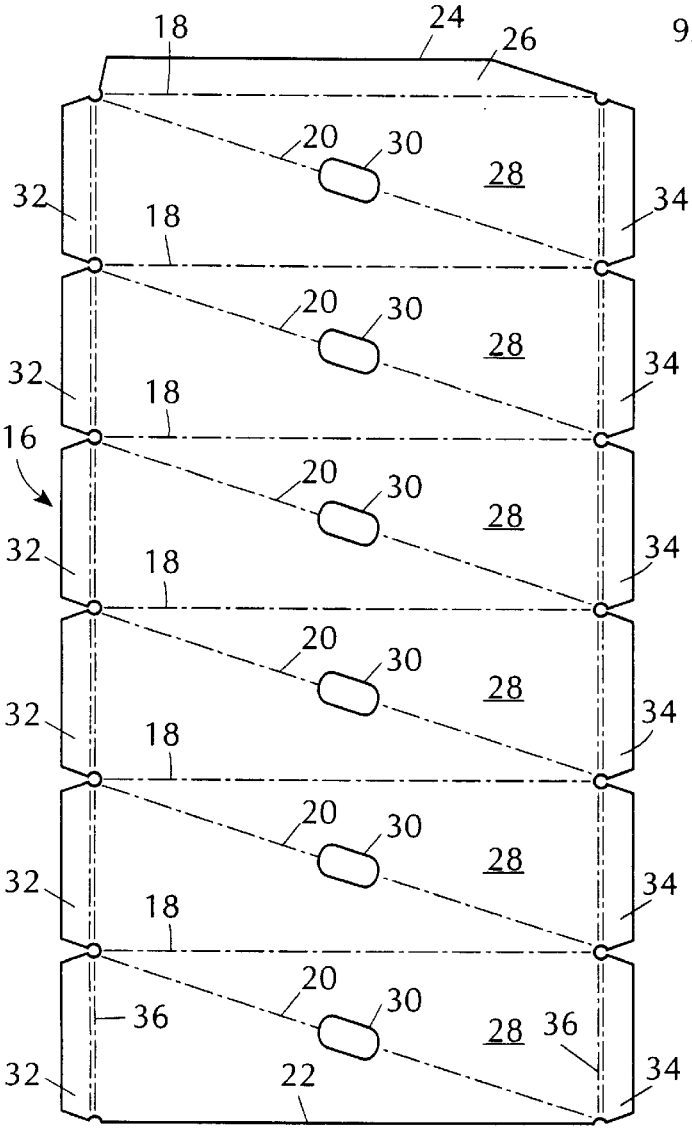
FIG. 5
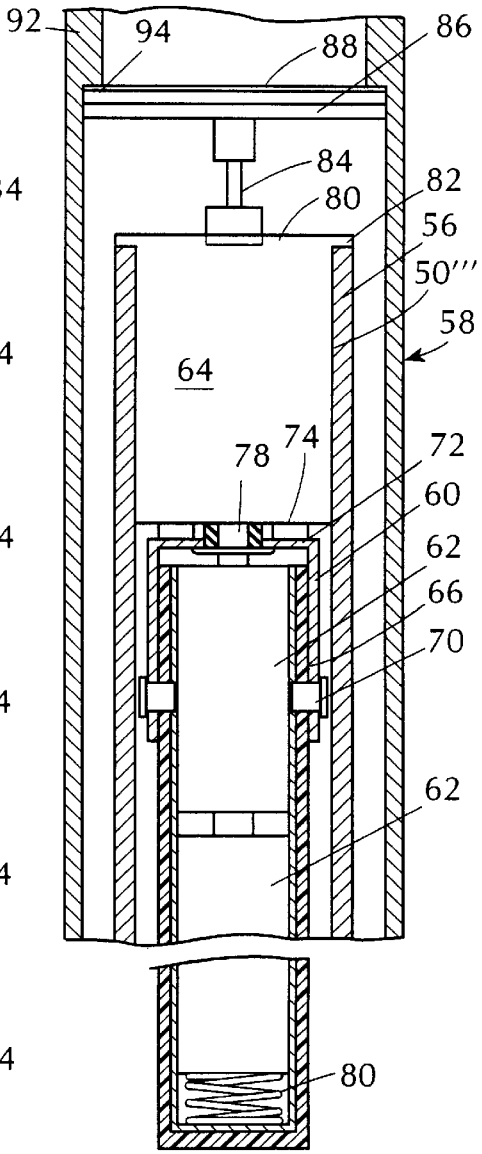

DISPLAY STAND

BACKGROUND OF THE INVENTION

The present invention relates to display stands, and more in particular to a display stand adapted to support a rotating sign.

In-store displays for products are exceedingly important marketing tools for manufacturers. Preferably, manufacturers of various products try to have their products displayed in stand-alone attractive units in order to draw attention to the product and promote their purchase. To do so it is often desirable that the display contain some moving elements.

While unusually shaped and attractive stands are desirable, there is the conflicting desire that these displays be easily moved, yet be relatively inexpensive, so that they can be transported from place to place in a store, or even from store to store, when necessary.

BRIEF SUMMARY OF THE INVENTION

In accordance with the present invention, an improved display stand is provided which includes an attractive base with a spiral twist-like appearance and a rotatable pole display.

Another object of the present invention is to provide a display stand which is adapted to fold flat for transportation and is easily opened to a spiral-like configuration.

Yet another object of the present invention is to provide a display stand of the character described which is relatively simple in construction and inexpensive to manufacture.

In accordance with an aspect of the present invention a collapsable display stand is provided which is formed of a foldable, preferably cardboard, blank having two free ends and six integral rectangular panels separated by a set of parallel first fold lines respectively located along the sides of the rectangular panels. The rectangular panels also have a second set of fold lines formed therein located diagonally in the panels and parallel to each other there to define two triangular panel segments in each of the rectangular panels. The rectangular panels each have a central opening formed therein along its associated diagonal fold line. As a result, when the blank is folded in a first direction along the first set of fold lines and in a second opposite direction about the second set of fold lines and when the free ends of the blank are joined together, the blank defines a structure for a display stand having twelve triangular sides and top and bottom edges being hexagonal in plan. The central portion of the structure, between the top and bottom edges, has a maximum dimension that is less than the maximum dimension of the top and bottom edges so that the display stand has a spiral-like appearance which is narrower at its waist than at its top and bottom edges. The stand is also collapsable to a flat form for storage and transportation.

Collapsable display stands or containers have previously been proposed such as, for example, are shown in U.S. Pat. Nos. 3,912,156 and 2,936,145. However, in these prior art patents, the maximum dimension throughout the entire height of the article remains the same. In addition, the number of sides in each of stands or containers is relatively limited as compared to the present invention. Thus, for example, in U.S. Pat. No. 3,912,156, while the packing container has hexagonal top and bottom openings, it only has six sides. With the present invention a substantially increased number of sides is provided in the display stand which enhances the spiral appearance and the attractive nature of the stand.

The stand of the present invention also includes a rotatable pole display supported in the spiral twist-like stand. The pole display includes an elongated pole having an upper end and a lower end supported in the spiral twist-like stand. An electric motor is mounted in the upper end of the pole. Battery means are provided for supplying power to the motor when the motor is moved into a position in alignment with the battery. The motor is connected to a drive disc which is adapted to be rotated by the motor in a plane perpendicular to the axis of the pole and above the upper end thereof. A display means is mounted on the drive disc for rotation thereby.

The above, and other objects, features and advantages of the present invention will be apparent from the following detailed description of an illustrative embodiment thereof, which is to be read in connection with the accompanying drawings, wherein:

BRIEF DESCRIPTION OF THE DRAWINGS

FIG. 4 is an exploded perspective view of the drive motor and associated battery holder;

FIG. 5 is an enlarged sectional view showing the motor and battery holder mounted in the upper end of the display pole;

FIG. 6 is a plan view of the cardboard blank used to form the display stand of the present invention;

FIG. 8 is a plan view of the display stand in its folded condition.

DETAILED DESCRIPTION OF THE INVENTION

Figure 1:
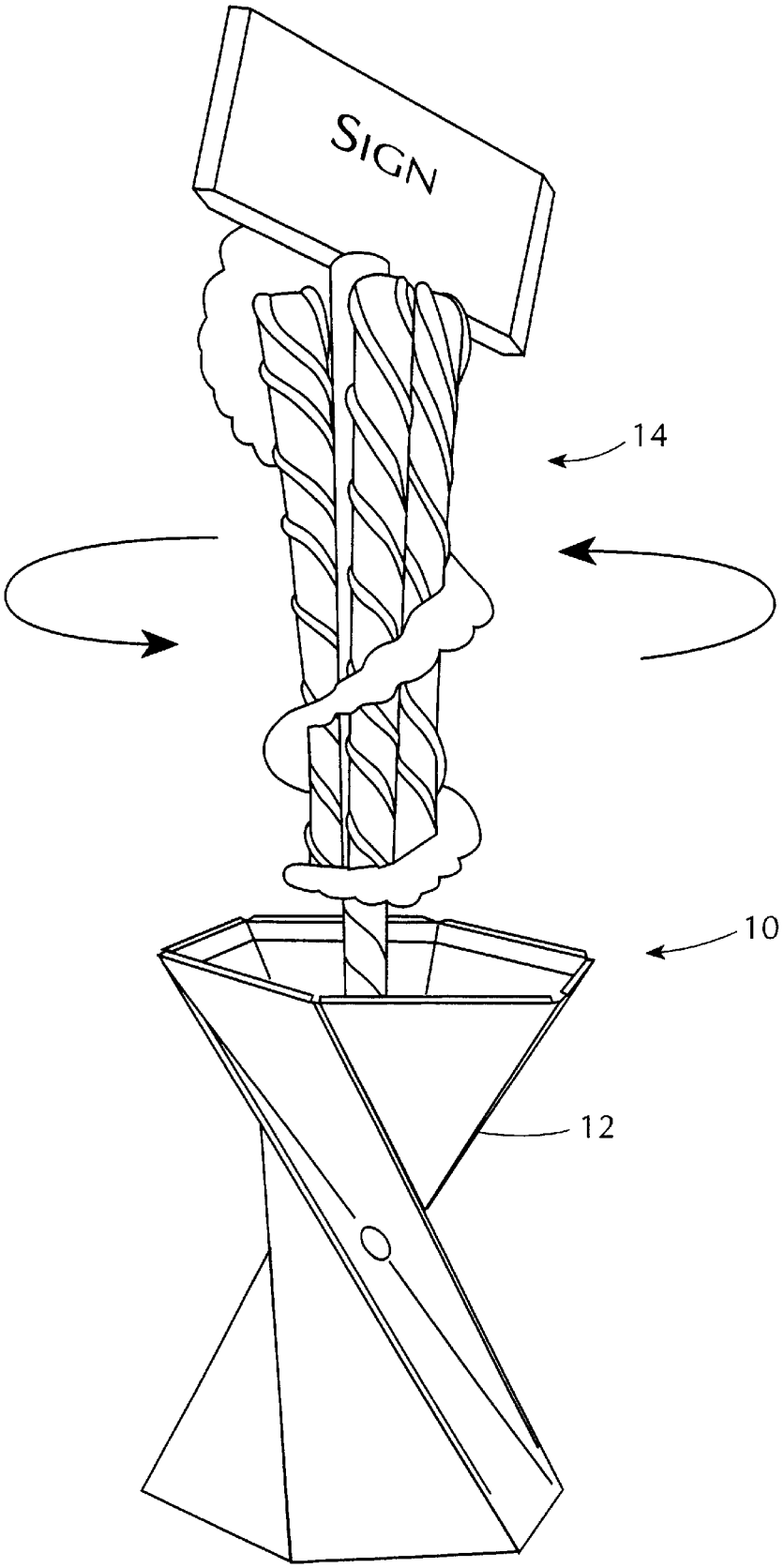
FIG. 1 is a perspective view of a display stand constructed in accordance with the present invention.

Referring now to the drawings in detail, and initially to FIG. 1 thereof, a display unit 10, constructed in accordance with the present invention is illustrated. The display unit includes a base or display stand 12 and a rotatable upper pole unit 14.

Display stand 12 is preferably constructed of foldable cardboard and is constructed to have a spiral twist-like appearance. The stand unit may be used alone or in conjunction with the rotatable pole 14, as described herein in detail.

FIG. 6 illustrates the cardboard blank 16 from which display stand 12 is formed. Blank 16 is a generally elongated rectangular member which has two sets of fold lines 18, 20. There are six fold lines 18 which are equally spaced from each other beginning at the edge 22 of blank 16, thereby to define six rectangular panels 28. The opposite end 24 of blank 16 defines a small flap 26 between the last fold line 18 and edge 24, which serves to secure the ends of the blank together, as described hereinafter.

The second set of fold lines 20 in blank 16 are formed along diagonals in the rectangular panels 28 defined by fold lines 18.

Panels 28, as seen in FIG. 6, are substantially longer in height than in their width between the fold lines 18. Each panel includes a central opening 30 cut therein along its associated fold line 20. These openings cooperate when the display stand is formed to define an opening which aids in supporting the pole display 14. In the collapsed condition of the display stand, shown in FIG. 9, these openings provide a hand-hold 30' for the collapsed stand.

Blank 16 also includes a plurality of end flaps 32, 34 formed on the ends of each of the panels 28, along fold lines 36. In the assembled configuration of display stand 12 these flaps are folded over onto the inner surfaces of the panels 28 to form finished upper and lower edges along fold lines 36.

Figure 7:
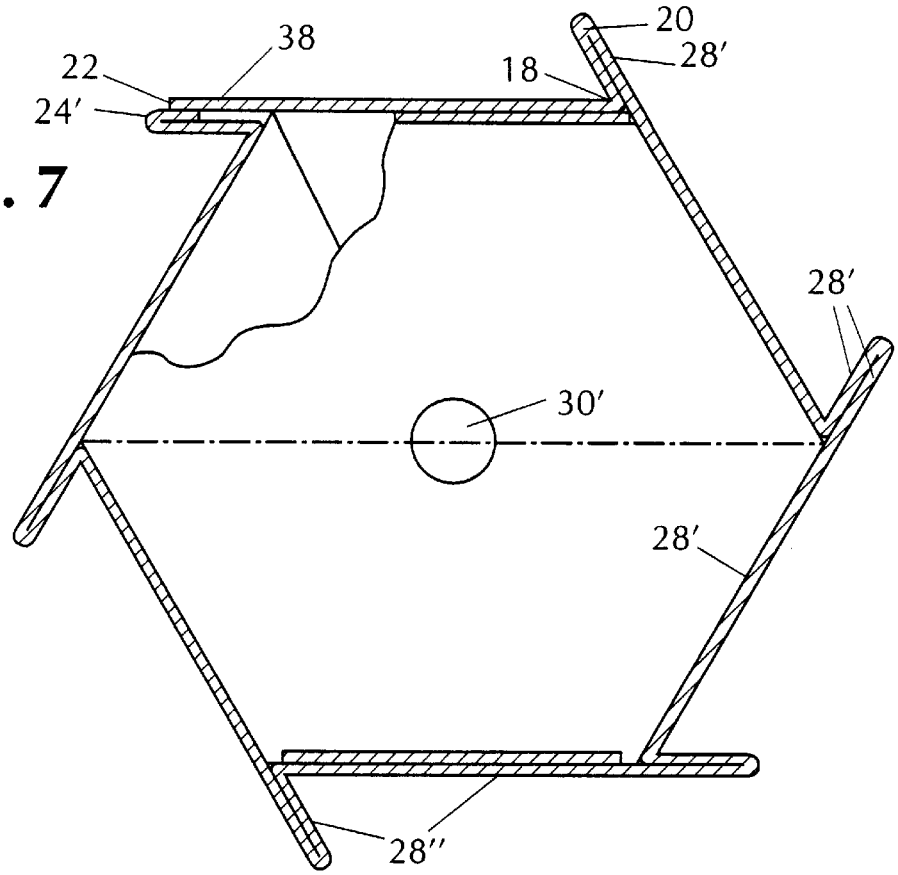
FIG. 7 is a top plan view, in section, taken along line 7—7 of FIG. 3.

Display stand 12 is formed by folding the segments of the blank 16 along fold lines 18, 20 and 36. First, flaps 32, 34 are folded along fold lines 36 (which may be scored or partial cut lines in the cardboard—as may the other fold lines 18, 20) so that the inner faces 32', 34' thereof engage the inner surface 28' of their associated panels 28. Thereafter, as seen in FIG. 7, blank 16 is folded along the fold lines 20 so that portions of the inner faces 28' of the triangular panels in each panel 28 will overlie and contact each other. At the same time, panels 28 are folded outwardly in the opposite direction along the fold lines 18 so the outer faces 28" of the triangular panel sections face but do not contact each other (see FIG. 7). Preferably, the inner facing portions 28' of the triangular sections of each panel are adhered together by an adhesive, or other suitable connecting means (for example, even Velcro tapes), into the position shown in FIG. 7.

Finally, flap 24 is folded along its associated fold line 18 over the inner surface 28' of the adjacent triangular panel segment and its inner surface 24' adhered thereto. Its outer surface 24" is then adhered at 38 to the free end 22 of blank 16 to form the completed structure. Openings 30 cooperate to form a circular hole 30' in the center of the structure, which now appears, as seen in FIG. 1, as a generally spiral-like twist whose waist is narrower than the hexagonally-shaped top and bottom edges thereof.

Figure 8:
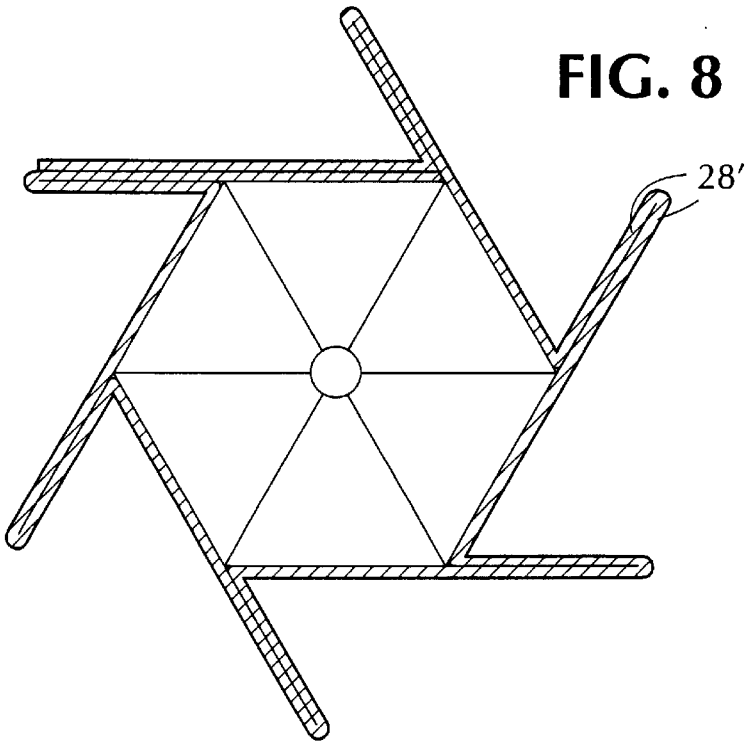
FIG. 8 is a top plan view, in section, taken along line 8—8 of FIG. 3.

FIG. 8 is a sectional view of the display stand closer to the central portion thereof than FIG. 7. These figures illustrate the tapering of the display stand both in width and in the cross-section of the stand formed by the taper. They also illustrate the increased overlap of the triangular panel sections at the central portion of the display stand which creates the narrow waist in the product.

Figure 9:
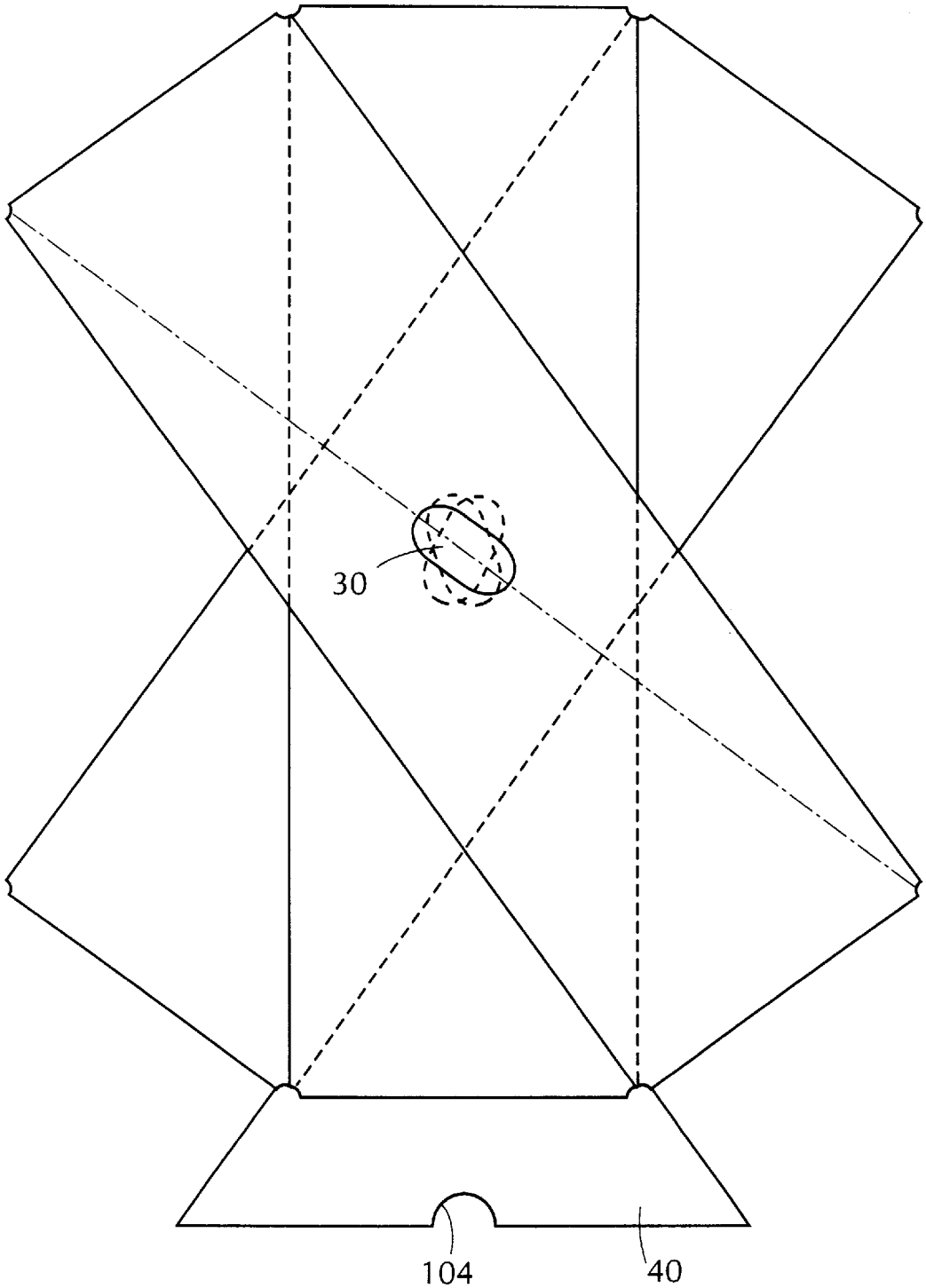

Display stand 12 is easily collapsable to the folded flat configuration shown in FIG. 9. This is accomplished by merely pushing two diammetrically opposed corners of the display stand together. That forces the blank to continue to fold along fold lines 18. If desired, a bottom insert 40 of cardboard construction can be secured in the bottom opening of the display to hold the bottom in its opened position when the stand is in use. As seen in FIG. 9, this insert folds in half when the stand is collapsed. A similar insert (not shown) can be used in the top of the display stand and simply seated in the upper opening in order to form a base for products to be displayed within the stand.

Figure 3:
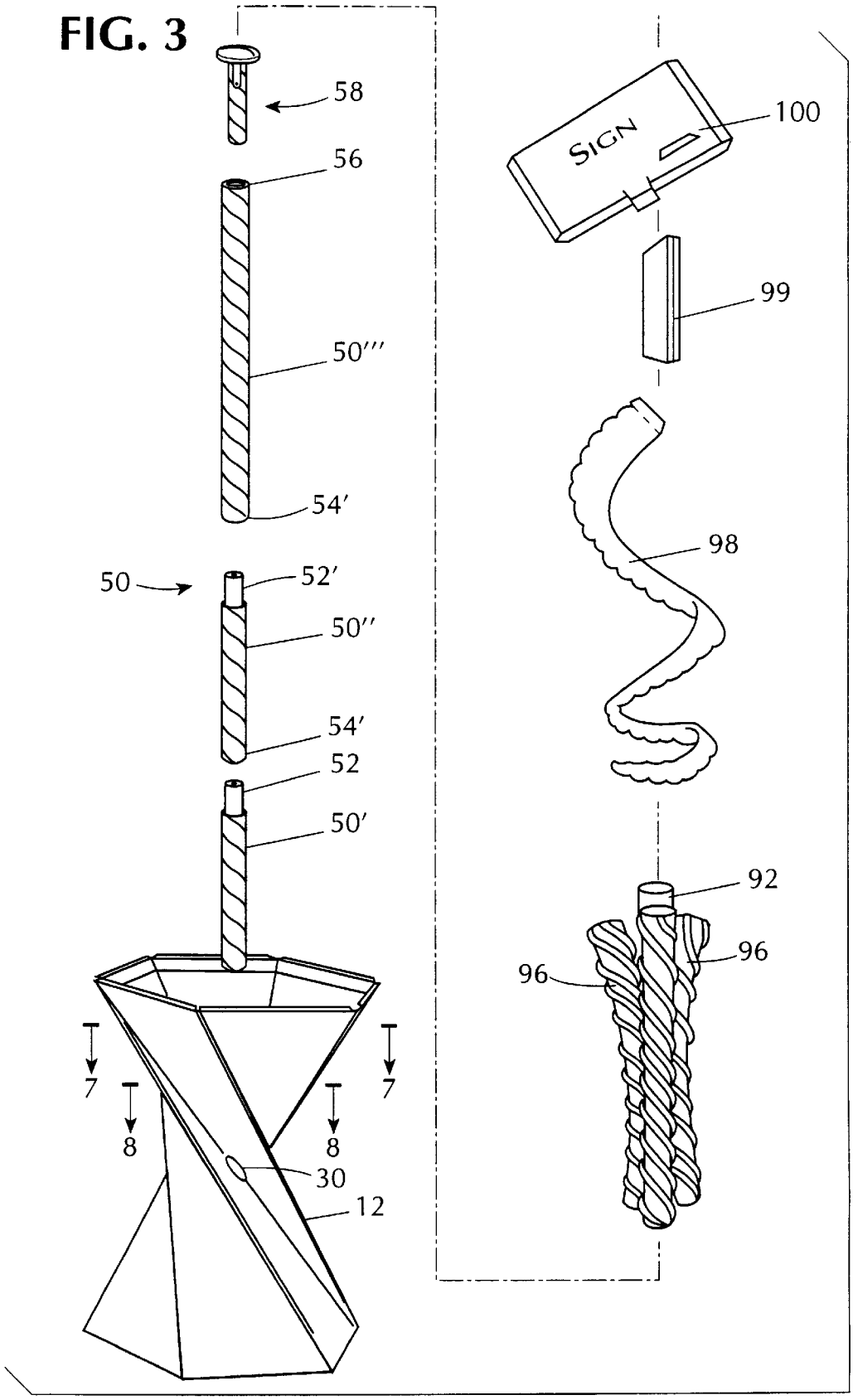
FIG. 3 is an exploded perspective view of the display stand shown in FIG. 1.

As noted above, the display stand of the present invention includes a rotatable pole display supported in base 12. This rotatable display includes a hollow vertical tube assembly 50 which, as seen in FIG. 3, is formed of a plurality of telescopic sections 50', 50" and 50'". These pole sections can be formed of plastic or cardboard with pole sections 50' and 50" having a male insert 52' secured in their upper ends which is received in the open lower ends 54' of pole segments 50" and 50'".

The upper end 56 of pole segment 50'" is adapted to receive a drive mechanism 58. This drive mechanism is shown in greater detail in FIGS. 2 and 5. It includes a battery carrier case 60 which, as seen in FIG. 5, is a generally cylindrical tube-like element adapted to contain one or more batteries 62. Tube 60 has a diameter which is less than the diameter of the opening 56 in pole section 50'" so that it will be telescopically received in the pole 50'".

An electric rotary motor 64 is pivotally mounted on the tube 60 by a U-shaped brace 66 (see FIG. 4). Brace 66 has legs 68 which are pivotally mounted at their ends by pivot pins 70 or the like to diammetrically opposed points on tube section 50'". The motor is mounted on the bight portion 72 of brace 66. Base 74 of the motor has a contact 78 which extends through bight 66 for engagement with the battery 62 when the motor is pivoted on brace 66 into axial alignment with the tube 60. As seen in FIG. 5, batteries 62 are biased toward the motor to maintain this engagement by a spring 80 in the conventional manner. Thus, when motor 64 is pivoted into alignment with the batteries power is supplied to the motor.

Motor 64 includes an upper end 80 having an annular flange 82 which is adapted to sit on the upper end 56 of pole section 50'". The motor also has a diameter which is slightly less than the internal diameter of pole section 50'" so that it can be telescopically mounted therein. In this way, when the motor is pivoted into alignment with the battery case 60, the entire assembly can be received in the pole 50'" and the motor supported thereon.

Motor 64 includes a rotatable output shaft 84 to which a drive disc 86 is secured in any convenient manner. Drive disc 86 rotates with shaft 84 when current is supplied to motor 64. Drive disc 86 includes surface 88 on its upper end. The drive surface is coated with a tacky releasable adhesive of any suitable material. As seen in FIG. 5, drive disc 86 is adapted to rotate in a plane perpendicular to the axis of the pole section 50'".

Figure 2:
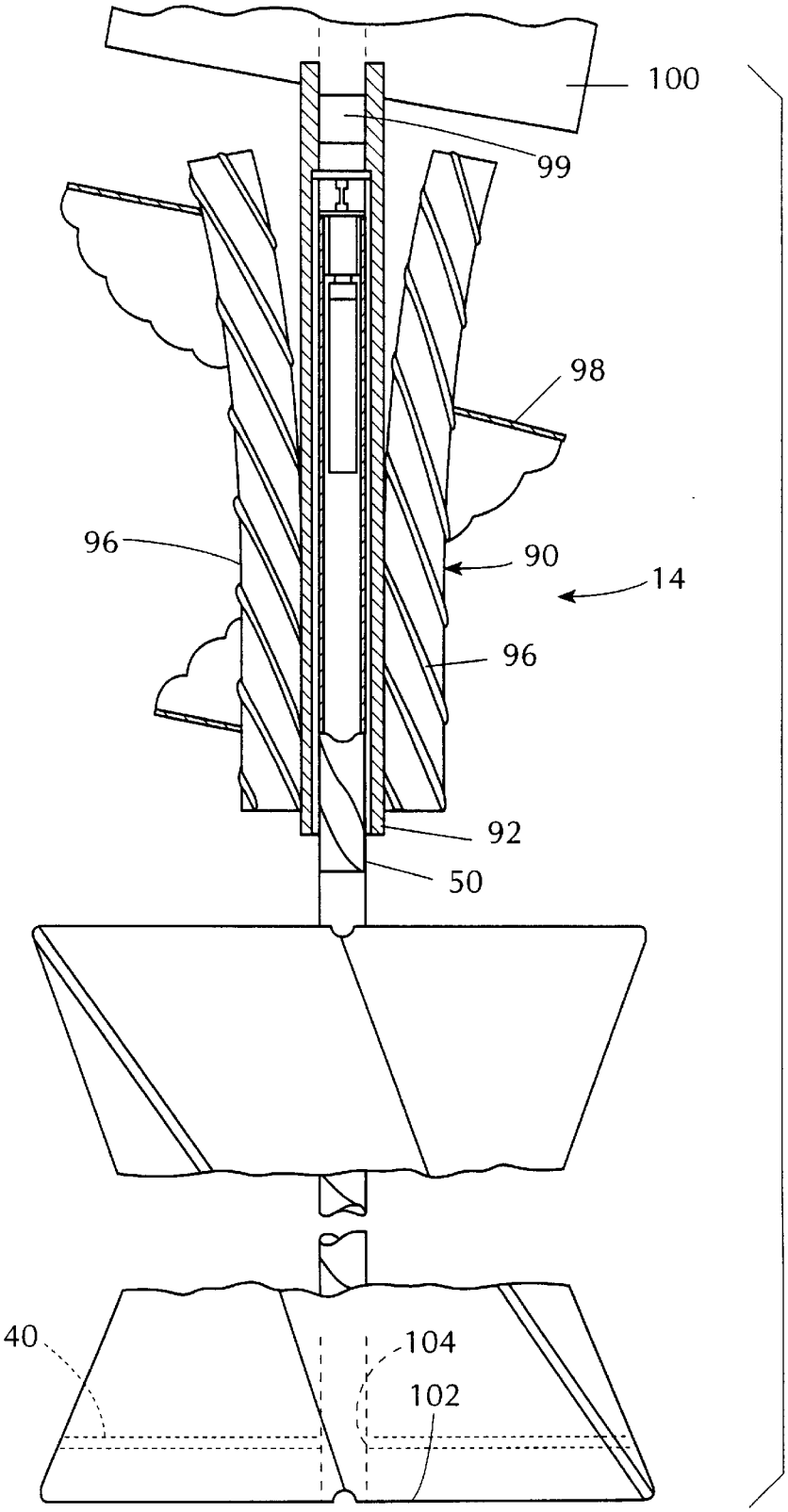
FIG. 2 is an elevational view of the display stand shown in FIG. 1, with parts broken away and other parts in section.

By this construction motor 64 is adapted to drive the sign assembly 90 of unit 14, shown in greater detail in FIGS. 2 and 3. Sign assembly 90 includes a hollow pole 92 which has a larger internal diameter than the external diameter of the pole section 50'" and disc 86 so that disc 86 and pole section 50'" can be received therein. Pole 92 includes an internal shoulder 94 which rests on the upper surface 88 of drive disc 86 when pole 92 is installed in place. By this arrangement pole 92 is releasably secured to drive disc 86 which will also cause pole 92 to rotate when the motor is operated.

Various types of signs and appendages can be secured to pole 92 as desired. In the illustrative embodiment of the invention, plastic simulated twist candy strings 96 are secured to pole 92 in any convenient manner. In addition, a paper twisted decoration 98 is wrapped around twists 96 and secured thereto by adhesive, or the like. Finally, a sign support 99 is friction fit into the top of the pole 92 and a sign 100 is secured thereto in any convenient manner. This entire assembly is rotated by motor 64 when current is supplied thereto.

As will be appreciated, when pole assembly 50 is placed in stand 12, the pole will pass through the opening 30' (see FIG. 7) formed by the openings 30 so that it is supported in the display stand by the edges of that opening. In addition, bottom end 102 of the pole assembly will pass through an opening 104 in the base member 40 so that the pole is vertically supported at two locations.

By this construction, a simple and economically assembled display stand is provided which has a highly attractive spiral twist-like appearance having multiple sides which is adapted to fold quickly and simply into a compact configuration. At the same time the structure supports a pole structure so that its upper end can rotate and provide an additional attractive display feature.

Although the present invention has been described herein with reference to the accompanying drawings, it is to be understood that this invention is not limited to that precise embodiment and that various changes and modifications may be effected therein by those skilled in the art without departing from the scope and spirit of this invention.

What is claimed is:

1. A collapsible display stand comprising a foldable blank having two free ends and including six integral rectangular panels separated by a set of parallel first fold lines respectively located along the sides of the rectangular panels;

said panels also having a second set of fold lines located diagonally in said panels and parallel to each other defining two triangular panel segments in each of said rectangular panels;

said rectangular panels each having a central opening formed therein along its associated diagonal fold line;

whereby when said blank is folded in a first direction along said first set of fold lines and in a second direction about said second set of fold lines and said free ends of the panels are joined together said blank defines a structure having twelve triangular sides and top and bottom edges being hexagonal in plan, with the central portion of said structure between said top and bottom edges having a maximum width dimension that is less than the maximum width dimension of said top and bottom edges;

said foldable blank having an inner surface and an outer surface and said blank being alternatively folded along said first set of fold lines to engage a portion of the inner surface of each triangular panel segment with a portion of the triangular panel segment on the opposite side of the fold line of the first set of fold lines between each such triangular segment;

said blank being folded along said second set of fold lines in a direction opposite to the direction in which the blank is folded along said first set of fold lines; and one free end of said blank being defined by the edge of one of said rectangular panels and the other free edge including an elongated flat narrow flap separated from an adjacent rectangular panel by a fold line in said first set;

said flap being folded in said first direction to position its inner face against the inner face of its adjacent triangular panel segment and means for securing said one free end of the blank to the outer surface of said flap.

2. A collapsable display stand as defined in claim 1 including means for securing said inner surface portions of said triangular panel segments together.

3. A collapsable display stand as defined in claim 1 wherein said securing means is an adhesive.

4. A blank as defined in claim 1 wherein said rectangular panels are longer in the direction of said first fold lines than the width between fold lines.

5. A blank as defined in claim 1 including an aperture centrally formed in each of said rectangular panels along the diagonal fold line therein.

6. A blank as defined in claim 5 wherein said blank has top and bottom edges and a plurality of extension flaps on said edges adjacent the ends of the rectangular panels and joined thereto along fold lines.

7. A rotary pole display comprising an elongated display pole having an open upper end, an electric motor received in said upper end of the pole and means on said motor for cooperating with said upper end of the pole for supporting the motor on said upper end and within the pole;

battery means for supplying power to said motor; and drive means connected to said motor for rotation thereby;

said drive means comprising a drive disc lying in a plane above and perpendicular to said upper end of the pole; and display means mounted on said drive disc for rotation thereby.

8. A rotary pole display comprising an elongated display pole having an open upper end, an electric motor received in said upper end of the pole and means on said motor for cooperating with said upper end of the pole for supporting the motor therein;

battery means for supplying power to said motor; and drive means connected to said motor for rotation thereby;

said drive means comprising a drive disc lying in a plane above and perpendicular to said upper end of the pole; and display means mounted on said drive means for rotation thereby;

wherein said battery means comprises a hollow tube having an open end and adapted to be telescopically received in said pole, at least one battery received in said tube and means for pivotally mounting said motor to said tube adjacent said open end;

said motor having electrical contact means for engaging said at least one battery when said motor is in place in axial alignment with said tube.

9. A rotary pole display comprising an elongated display pole having an open upper end, an electric motor received in said upper end of the pole and means on said motor for cooperating with said upper end of the pole for supporting the motor therein;

battery means for supplying power to said motor; and drive means connected to said motor for rotation thereby;

said drive means comprising a drive disc lying in a plane above and perpendicular to said upper end of the pole; and display means mounted on said drive means for rotation thereby;

wherein said display means includes a second elongated pole dimensioned to telescopically receive said first pole and said drive disc and means in said second pole for engaging said drive disc for rotation thereby.

10. A rotary pole display as defined in claim 9 wherein said battery means comprises a hollow tube having an open end and adapted to be telescopically received in said pole, at least one battery received in said tube and means for pivotally mounting said motor to said tube adjacent said open end;

said motor having electrical contact means for engaging said battery when said motor is placed in axial alignment with said tube.

11. A rotary pole display as defined in claim 10 including a display stand for vertically supporting said pole.

12. A rotary pole display as defined in claim 11 wherein said stand comprises a foldable blank having two free ends and including six integral rectangular panels separated by a set of parallel first fold lines respectively located along the sides of the rectangular panels;

said panels also having second set of fold lines located diagonally in said panels and parallel to each other defining two triangular panel segments in each of said rectangular panels;

said rectangular panels each having a central opening formed therein along its associated diagonal fold line;

whereby when said blank is folded in a first direction along said first set of fold lines and in a second direction about said second set of fold lines and said free ends of the panels are joined together, said blank defines a structure having twelve triangular sides and top and bottom edges being hexagonal in plan, with the central portion of said structure between said top and bottom edges having a maximum width dimension that is less than the maximum width dimension of said top and bottom edges;

said central openings in said blank defining a support opening for said pole in the stand and receiving said pole for supporting the pole in a vertical position.

13. A rotary pole display as defined in claim 12 wherein said elongated display pole includes a lower end and said display stand includes means in said display stand adjacent the bottom edge thereof for receiving the lower end of said pole and providing additional vertical support therefor.

14. A rotary pole display as defined in claim 8 including a display stand for vertically supporting said pole.

15. A rotary pole display as defined in claim 14 wherein said stand comprises a foldable blank having two free ends and including six integral rectangular panels separated by a set of parallel first fold lines respectively located along the sides of the rectangular panels;

said panels also having a second set of fold lines located diagonally in said panels and parallel to each other defining two triangular panel segments in each of said rectangular panels;

said rectangular panels each having a central opening formed therein along its associated diagonal fold line;

whereby when said blank is folded in a first direction along said first set of fold lines and in a second direction about said second set of fold lines and said free ends of the panels are joined together, said blank defines a structure having twelve triangular sides and top and bottom edges being hexagonal in plan, with the central portion of said structure between said top and bottom edges having a maximum width dimension that is less than the maximum width dimension of said top and bottom edges;

said central openings in said blank defining a support opening for said pole in the stand and receiving said pole for supporting the pole in a vertical position.

16. A rotary pole display as defined in claim 15 including means in said display stand adjacent the bottom edge thereof for receiving the lower end of said pole and providing additional vertical support therefor.

17. A rotary pole display as defined in claim 7 including a display stand for vertically supporting said pole.

18. A rotary pole display as defined in claim 17 wherein said stand comprises a foldable blank having two free ends and including six integral rectangular panels separated by a set of parallel first fold lines respectively located along the sides of the rectangular panels;

said panels also having a second set of fold lines located diagonally in said panels and parallel to each other defining two triangular panel segments in each of said rectangular panels;

said rectangular panels each having a central opening formed therein along its associated diagonal fold line;

whereby when said blank is folded in a first direction along said first set of fold lines and in a second direction about said second set of fold lines and said free ends of the panels are joined together, said blank defines a structure having twelve triangular sides and top and bottom edges being hexagonal in plan, with the central portion of said structure between said top and bottom edges having a maximum width dimension that is less than the maximum width dimension of said top and bottom edges;

said central openings in said blank defining a support opening for said pole in the stand and receiving said pole for supporting the pole in a vertical position.

19. A rotary pole display as defined in claim 18 including means in said display stand adjacent the bottom edge thereof for receiving the lower end of said pole and providing additional vertical support therefor.

* * * * *